US005931213A

United States Patent [19]

Khalili et al.

[11] Patent Number: 5,931,213

[45] Date of Patent: Aug. 3, 1999

[54] METHOD OF CASTING AN ENGINE BLOCK OF ALUMINUM

[75] Inventors: Azita Khalili, Saarbrücken; Herbert Smetan, Rehlingen, both of Germany

[73] Assignee: VAW alucast GmbH, Dillingen, Germany

[21] Appl. No.: 08/859,884

[22] Filed: May 21, 1997

[51] Int. Cl.[6] ..... B22D 15/02

[52] U.S. Cl. ..... 164/127; 164/356

[58] Field of Search ..... 164/107, 127, 164/352, 353, 354, 355, 356, 371, 76.1

[56] References Cited

FOREIGN PATENT DOCUMENTS 3509015 9/1985 Germany ..... 164/127

*Primary Examiner*—Kuang Y. Lin

*Attorney, Agent, or Firm*—Friedrich Kueffner

[57] ABSTRACT

A method of casting an engine block of aluminum whose working surfaces, after milling the interiors of the cylinders, are coated with a harder metal, particularly nickel, includes inserting permanent molds in the sand mold and manufacturing the cylinder interiors of a metal which has a thermal expansion coefficient of greater than $18\times10^{-6}K^{-1}$.

8 Claims, 1 Drawing Sheet

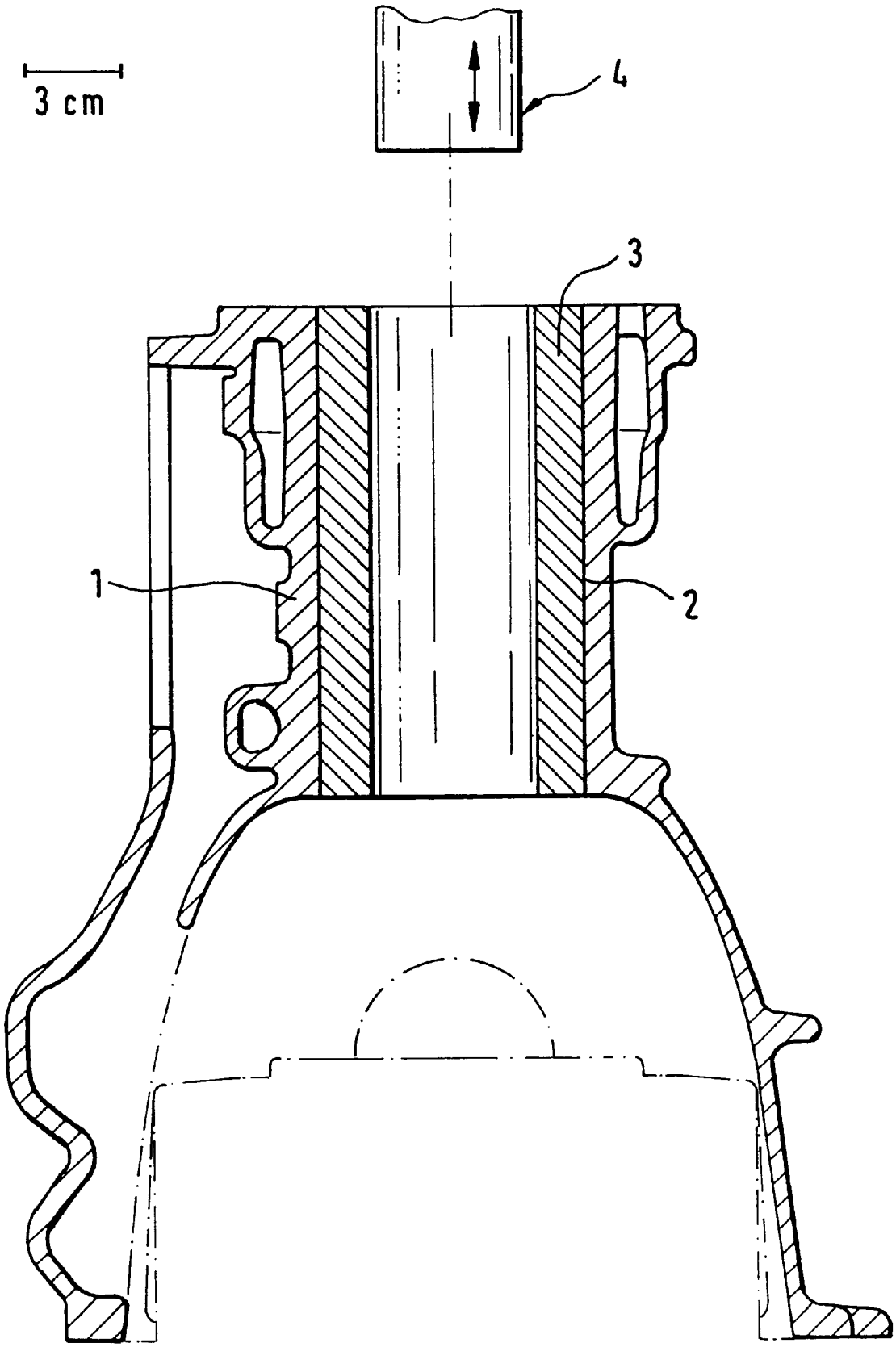
3 cm
4
3
1
2

METHOD OF CASTING AN ENGINE BLOCK OF ALUMINUM

BACKGROUND OF THE INVENTION

1. Field of the Invention

The present invention relates to a method of casting an engine block of aluminum whose working surfaces, after milling the interiors of the cylinders, are coated with a harder metal, particularly nickel.

2. Description of the Related Art

Engine blocks of aluminum require a harder metal at the working surfaces.

One possibility of providing the harder metal by the casting alloy itself is to use a hypereutectoid alloy which precipitates silicon. The cast article then has sufficient hardness and resistance to wear for forming the working surfaces directly. The manufacture can be carried out by the sand casting method.

Engine blocks of a hypoeutectoid alloy are provided with cylinder inserts with gray cast iron which are cast in or they are provided with a galvanically applied coating of nickel. The coating with nickel requires a surface quality which in the past could only be produced by the permanent mold casting method. However, permanent mold casting is frequently work intensive, primarily because of the removal from the mold and the variety of possible shapes is smaller than compared to the sand casting method. The engine blocks with the inserts of gray cast iron are also manufactured by the permanent mold casting method.

SUMMARY OF THE INVENTION

Therefore, it is the primary object of the present invention to manufacture engine blocks of aluminum with working surfaces capable of coating by using the sand casting method.

In accordance with the present invention, the above object is met by inserting permanent molds in the sand mold and manufacturing the cylinder interiors of a metal which has a thermal expansion coefficient of greater than $18\times10^{-6}K^{-1}$.

Due to the higher thermal conductivity of the metal, the cast aluminum solidifies at the surface of the permanent mold more quickly than at the surface of the sand mold. This results in a better structure at the surface of the permanent mold up to a depth within which metal is removed during milling. In particular, the porosity due to shrinkage is significantly reduced.

A homogeneous, essentially pore-free coating is produced on the milled surfaced which is improved in the above-described manner. The pores in the aluminum structure, if they exist at all, have very small diameters. They have hardly any effect into the coating.

Accordingly, the present invention combines the methods of permanent mold casting with sand casting by specifically using the permanent mold casting method for producing the interiors of the cylinders of the engine block which are otherwise manufactured by sand casting, wherein, however, there is the additional aspect of using a different permanent mold material.

The relatively high coefficient of expansion of the permanent mold material is close to that of aluminum in order to be able to remove the permanent mold from the cast piece without heating. Preferably, the coefficient of expansion of the permanent mold is $20\times10^{-6}K^{-1}$ or even slightly more.

In accordance with a particularly advantageous embodiment of the present invention, the use of a permanent mold of brass is proposed. When using suitable alloy compositions, brass reaches thermal expansion coefficients of $20\times10^{-6}K^{-1}$ and, in addition to a high thermal conductivity, has a thermal capacity which is capable of removing sufficient heat from the solidifying aluminum, even if, in accordance with a preferred feature, the permanent mold is constructed as a hollow cylinder.

In accordance with another proposal, particularly suitable are permanent molds of a brass material having the approximate composition of 60% Cu, 2% Al, 2% Fe, 2% Mn, remainder Zn.

In accordance with another advantageous feature, the permanent molds have a slightly conical outer shape for facilitating removal of the mold from the cast piece. It is understood that the conicality must be less than the thickness of the layer being removed during milling of the cylinder liner.

Finally, in accordance with another feature of the present invention, the permanent molds are heated inductively prior to casting to about 140° to 160° C.

When the casting mold is being filled, the permanent mold should cool the melt flowing through the mold as little as possible. The heat-removing effect of the permanent mold should only occur in the filled state of the casting mold and on those material areas which form the interiors of the cylinders.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is an axial sectional view of a cylinder with a mold.

DESCRIPTION OF THE PREFERRED EMBODIMENTS

The single FIGURE of the drawing shows an engine block 1 in a sectional view at one of the cylinders of the engine block. The cylinder is provided with a working surface 2.

The drawing further shows the permanent mold 3 and a schematically illustrated inductor 4.

The mold 3, for example, of brass material as specifically indicated above, is mounted in the sand mold, usually a core pack, in a manner which is familiar to those skilled in the art.

Immediately prior to casting, the mold 3 is heated, for example, to about 150° C., by means of the inductor 4 which is inserted into the mold 3 for this purpose.

After removal of the sand mold, the permanent mold 3 is initially seated in the interior of the cylinder in the illustrated manner.

In order to be able to press the mold 3 out more easily, the outer surface of the mold 3 is slightly conical. Because the conicity is very slight, it is not visible in the drawing.

When the cast engine block is removed, the molds 3 initially remain seated in the interiors of the cylinders. They can be pressed out by means of a simple device with the application of a small force which does not lead to distortion of the engine block and to the formation of cracks.

Subsequently, the working surfaces are milled and coated, for example, with nickel in accordance with the known Nikasil method.

While specific embodiments of the invention have been shown and described in detail to illustrate the inventive principles, it will be understood that the invention may be embodied otherwise without departing from such principles.

I claim:

1. A method of casting an engine block of aluminum, the engine block having cylinder interiors with working surfaces to be milled and subsequently coated with a metal harder than aluminum, the method comprising forming a casting mold for casting the engine block by placing permanent molds in a sand mold, wherein the permanent molds are of a metal having a thermal expansion coefficient of more than $18\times10^{-6}K^{-1}$, and subsequently casting molten aluminum into the casting mold to form the engine block.

2. The method according to claim 1, wherein the metal harder than aluminum is nickel.

3. The method according to claim 1, comprising using permanent molds of a brass material.

4. The method according to claim 3, wherein the brass material has approximately the composition 60% Cu, 2% Al, 2% Fe, 2% Mn, remainder Zn.

5. The method according to claim 1, comprising using permanent molds having a slightly conical external shape.

6. The method according to claim 1, comprising using permanent molds each essentially having the shape of a hollow cylinder.

7. The method according to claim 6, comprising inductively heating the permanent molds prior to casting.

8. The method according to claim 7, comprising heating the permanent molds a temperature of 150° to 160° C.

* * * * *